US005735640A

United States Patent [19]

Meyer et al.

[11] Patent Number: 5,735,640

[45] Date of Patent: Apr. 7, 1998

[54] GEO TEXTILES AND GEOGRIDS IN SUBGRADE STABILIZATION AND BASE COURSE REINFORCEMENT APPLICATIONS

[75] Inventors: Bradley Ross Meyer, Eden Prarie, Minn.; William M. Mattel, Gainesville, Ga.

[73] Assignee: Nicolon Corporation, Norcross, Ga.

[21] Appl. No.: 627,045

[22] Filed: Apr. 3, 1996

[51] Int. Cl.[6] ..... B32B 5/02; D03D 9/00; E01C 11/16; E02D 17/20

[52] U.S. Cl. ..... 405/258; 404/70; 442/255

[58] Field of Search ..... 405/258; 404/70; 428/255

[56] References Cited

U.S. PATENT DOCUMENTS

| | | | |
|---|---|---|---|
| 2,139,816 | 12/1938 | Fordyce | 404/70 |
| 4,906,520 | 3/1990 | Kumar | 428/255 |
| 5,091,247 | 2/1992 | Willibey et al. | 405/258 X |

OTHER PUBLICATIONS

Al-Qadi, I.L., and Brandon, T.L., "Geoxynthetics Improve pavement Servie Life," *Erosion Control*, pp. 48–57, (Sep./Oct. 1994).

Barksdale, R.D., Brown, S.F., and Chan, F., "Potential Benefits of Geosynthetics in Flexible Pavement Systems," National Cooperative Highway Research program Report 315, Transportation Research Board, Washington, D.C. (1989).

Bender, D.A., and Barenberg, E.J., "Design and Behavior of Soil–Fabric–Aggregate Systems," Transportation Research Record 671, Transportation Research Board, Washington, D.C. (1978).

Christopher, B.R., and Holtz, R.D., "Geotextile Engineering Manual," Report FHWA–TS–86/203 STS Consultants, Ltd., Northbrook, IL, for Federal highway Administration, Washington, D.C. (1985).

Giroud, J.P., Ah-Line, C., and Bonaparte, R., "Design of Unpaved Roads and Trafficked Areas with Geogrids," Polymer Grid Reinforcement Conference Proceedings, published by Thomas Telford Limited, London, England (1985).

Giroud, J.P., and Noiray, L., "Geotextile–Reinforced Unpaved Road Design," *Journal of the Geotechnical Engineering Division*, American Society of Civil Engineers, vol. 107, No. GT9, pp. 1233–1254 (Sep. 1981).

Holtz, R.D., and Sivakugan, N., "Design Charts for Roads with Geotextiles," *Geotextiles and Geomembranes*, vol. 5, Elsevier Applied Science Publishers Ltd., England, pp. 191–199 (1987).

(List continued on next page.)

*Primary Examiner*—Tamara L. Graysay
*Assistant Examiner*—Tara L. Mayo
*Attorney, Agent, or Firm*—James L. Ewing, IV; Kilpatrick Stockton LLP

[57] ABSTRACT

Geosynthetics and structures for earth reinforcement, stabilization and retention. Membranes used in such structures are formed by weaving a number of fill members, which are preferably fibrillated polypropylene members or strips, with a plurality of warp member sets, which are preferably formed of extruded polypropylene yarns. The woven membrane so formed sustains the moderate tensile loads imposed by earth reinforcement requirements in roadways, runways, and other ways. It is inexpensive because the materials are inexpensive and may be woven in a cost efficient way, and, if desired, in a way which allows the strength and tensile properties of the membrane to be varied for a custom application by varying the composition, number and disposition of the fill members and warp members. These geosynthetic membranes provide superior results as compared to conventional extruded (and harder) conventional geogrids or other materials, because they are more flexible, easier to roll during manufacture, inventory, ship, and install. Such geosynthetics also feature a number of differently sized voids for effective soil and aggregate retention without filtration compromise. Finally, such geotextiles accommodate easier installation because successive sections may be more easily stitched, or otherwise fastened together.

22 Claims, 3 Drawing Sheets

OTHER PUBLICATIONS

Koerner, R.M., and Koerner, G.R., "Separation: Perhaps the Most Underestimated Geotextile Function," *Geotechnical Fabrics Report,* (Jan. 1994).

Steward, J., Williamson, R., and Mohney, J., "Guidelines for Use of Fabrics in Construction and Maintenance of Low-Volume Roads," Report No. FHWA-TS-78-205, U.S. Department of Transportation, Federal Highway Administration, Washington, D.C. (1977).

"Guidelines for Design of Flexible Pavements Using Mirafi Woven Geotextiles," (Mirafi, Inc., (1982)).

GEO TEXTILES AND GEOGRIDS IN SUBGRADE STABILIZATION AND BASE COURSE REINFORCEMENT APPLICATIONS

The present invention relates to geotextiles which feature strength and cost properties that allow superior performance in geosynthetic applications such as roadways and runways and other earthen structures.

BACKGROUND OF THE INVENTION

Geotextiles and geogrids have been employed for years in various earth reinforcement, erosion control and turf reinforcement products. "Earth reinforcement" in this document refers generally and broadly to activities and products which increase tensile and/or shear strength of earth or particulate structures such as in retaining wall structures, steep grades, level grades and other applications that compel tensile and/or shear strength enhancement of particulate substrate properties.

Various geotextile and geogrid structures, formed of various materials, are employed to accommodate earth reinforcement applications. For instance, geotextiles employed for earth reinforcement of steep grades require greater shear strength at least in one direction, and in some cases both directions. Steep grade earth reinforcement geosynthetics accordingly generally require stronger and more expensive structure and materials than do earth reinforcement geosynthetics for level grades.

Earth reinforcement requirements in level and graded structures such as roadways or runways, however, generally require more biaxial geosynthetic tensile and/or shear strength properties. Such applications also require more symmetrical tensile and/or shear strength properties than earth reinforcement materials employed in retaining wall structures and steep grades. These more level, more biaxial and less aggressive environments accordingly place a premium on geosynthetics which perform acceptably from a subgrade stabilization and base course reinforcement point of view, but which can be manufactured and supplied efficiently and inexpensively, and which can be rolled, stored, shipped and installed easily.

Subgrade stabilization is often required when weak subgrade conditions exist. In such subgrade stabilization applications, a geosynthetic is generally placed directly on top of a weak subgrade. The geosynthetic provides separation between the base course above and the subgrade below, improves bearing capacity, may enable a reduction in base course thickness, allows increased traffic and reduces permanent deformation within a surface or pavement system placed on top of base courses. Separation, reinforcement and filtration properties are among the more important properties when considering geotextiles for subgrade stabilization applications.

Improvement Mechanisms and Functions

Separation—Although localized bearing failures and subsequent intermixing of the subgrade soil with stone base course are problems in weak soils with California Bearing Ratio ("CBR") values of less than 3 (Christopher, B. R., and Holtz, R. D., "Geotextile Engineering Manual", Report FHWA-TS-86/203 STS Consultants, Ltd., Northbrook, Ill., for Federal Highway Administration, Washington, D.C., 1985), separation has been demonstrated as being effective in a silty sand environment for a CBR as high as 4.4 (Al-Qadi, I. L., and Brandon, T. L., "Geosynthetics Improve Pavement Service Life", *Erosion Control*, September/October 1994, pp. 48–57). Both of these documents are incorporated herein by this reference.

The separation function prevents contamination of the stone base course by intermixing with the subgrade soil, thus preserving the structural integrity and drainage capacity of the base course. Utilization of a separation geosynthetic minimizes the potential for aggregate being forced down into the subgrade by the action of the applied loads and subsequent migration of the subgrade up into the base course. As little as 10 to 20 percent intermixing of subgrade fines can completely destroy the strength of the base course (Steward, J., Williamson, R., and Mohney, J., "*Guidelines for Use of Fabrics in Construction and Maintenance of Low-Volume Roads*", Report No. FHWA-TS-78-205, U.S. Department of Transportation, Federal Highway Administration, Washington, D.C., 1977) (incorporated by this reference). Contamination of a stone base course by subgrade fines is effectively reduced, however, by the use of a geosynthetic functioning as a separator between the soil subgrade and the stone base course (Koerner, R. M., and Koerner, G. R., "Separation: Perhaps the Most Underestimated Geotextile Function", *Geotechnical Fabrics Report*, January 1994, Industrial Fabrics Association) (incorporated by this reference). The geosynthetic separator eliminates the increased layer of stone base course that would otherwise be required.

Bearing Capacity Improvement—A geosynthetics' inclusion can drastically change the potential mode of failure. The geosynthetic prevents the granular base course from punching into the soft foundation soils under the applied wheel or truck loads. As a result, base punching, or localized shear failure, changes to a general shear failure. This change allows the subgrade to develop its ultimate bearing capacity (Bender, D. A., and Barenberg, E. J., "Design and Behavior of Soil-Fabric-Aggregate Systems", Transportation Research Record 671, Transportation Research Board, Washington, D.C., 1978) (incorporated by this reference).

Reinforcement—When weak subgrades exist, deformation of the soil will result. As deformation of the soil occurs, large scale tension develops in the geosynthetic. This reinforcement is called tensioned-membrane support. For tensioned-membrane support to be significant, the subgrade strength should be less than a CBR of 3 (Barksdale, R. D., Brown, S. F., and Chan, F., "Potential Benefits of Geosynthetics in Flexible Pavement Systems", National Cooperative Highway Research Program Report 315, Transportation Research Board, Washington, D.C., 1989) (incorporated by this reference).

Tensioned-membrane support is illustrated in FIG. 9 of this document. The stress conditions in the base course under load are analogous to a loaded beam. Due to bending, the base experiences compression at the top and tension at the base under the wheel load. The cohesionless base course material has no tensile resistance and generally relies on the subgrade to provide lateral restraint. Weak subgrades provide very little lateral restraint; thus, the aggregate at the bottom of the base course tends to move apart, allowing intrusion of the soft subgrade.

A geosynthetic placed at the bottom of the base course restrains aggregate movement by providing tensile strength. The net effect is a change in the magnitude of stress imposed on the subgrade; a reduction directly under the loaded area, and an increase outside the loaded area. This spreading of the stresses over a larger area improves the load carrying capability of the pavement. Giroud, supra, indicates that geosynthetics which possess high modulus will provide more load spreading ability for the same rut depth. Reinforcement through tensioned-membrane support is, therefore, provided through the geosynthetic's load-strain characteristics and soil-geosynthetic frictional interaction.

Design—Unpaved Roads

Geotextiles—Geotextiles have been used since 1975 for the application of stabilizing weak subgrades. Design guidelines for geotextiles used for subgrade stabilization of unpaved roads are based from the results of large-scale field trials conducted by the U.S. Forest Service (Stewart, Williamson and Mohney, supra) and from laboratory model studies (Bender and Barenberg, supra). The U.S. Forest Service method considers the geotextile functioning as a separator only. The Bender and Barenberg method considers the reinforcing benefit of the geotextile as well as the separation benefit. These early research studies demonstrate that the use of a geotextile on subgrades with a CBR<3 can result in an aggregate base course savings of 30% to 50% (Holtz, R. D., and Sivakugan, N., "Design Charts for Roads with Geotextiles", *Geotextiles and Geomembranes,* Volume 5, Elsevier Applied Science Publishers Ltd, England, 1987, pp. 191–199) (incorporated by this reference) and an increase in the subgrade load capacity (i.e. bearing capacity) by nearly 100% (Bender and Barenberg, supra; Stewart, Williamson, and Mohney, supra).

Giroud and Noiray (Giroud, J. P., and Noiray, L., "Geotextile-Reinforced Unpaved Road Design", *Journal of the Geotechnical Engineering Division,* American Society of Civil Engineers, Vol. 107, No. GT9, 1981, pp. 1233–1254) (incorporated by this reference) provide a design procedure incorporating tensioned-membrane support (i.e. reinforcement) to account for increased improvement as a function of geotextile tensile modulus. This design procedure has also been compared to the results of full scale tests conducted by the U.S. Army Corps of Engineers on unpaved roads with and without a geotextile (Webster, S. L., and Alford, S. J., "Investigation of Construction Concepts for Pavements Across Soft Grounds", Technical Report S-78-6, U.S. Army Engineer Waterways Experiment Station, Vicksburg, Miss. 1978) (incorporated by this reference). Comparison of calculated and actual thicknesses shows a good agreement when traffic is light; the theoretical results appear conservative when traffic is heavy (Giroud and Noiray, supra). The Giroud and Noiray design method provides similar improvements in terms of aggregate savings and bearing capacity improvement as compared to methods provided by Bender and Barenberg, supra and Steward, Williamson and Mohney, supra.

Design—Paved Roads

Design procedures for unpaved roads cannot be used for permanent flexible pavements (Giroud, J. P., Ah-Line, C., and Bonaparte, R., "Design of Unpaved Roads and Trafficked Areas with Geogrids", Polymer Grid Reinforcement Conference Proceedings, published by Thomas Telford Limited, London, England, 1985) (incorporated by this reference). The major difference is the in-service performance requirements of paved versus unpaved roads. Unpaved road design allows some rutting to occur over the life of the structure. However, a paving surface (concrete or asphalt) cannot be placed on a structure that yields or ruts under load since the surfaces would eventually crack and deteriorate. Such cracking and rutting would destroy the integrity of the pavement structure.

Design guidelines and procedures for using geotextiles in flexible pavement road construction can be found in the "Geotextile Engineering Manual" (Christopher and Holtz, supra) and in "Guidelines for Design of Flexible Pavements Using Mirafi Woven Geotextiles" (Mirafi, Inc., 1982) (incorporated by this reference), both of which are incorporated herein by this reference. Standard AASHTO design methods are used for the overall pavement system. In using design procedures which incorporate geosynthetics into flexible pavements for roads, no structural support is assumed to be provided by the geosynthetic, and therefore, no reduction is allowed in the aggregate thickness required for structural support (Christopher and Holtz, supra). However, aggregate savings can be achieved when using a geosynthetic through a reduction in the aggregate required in the first lift, referred to as the 'stabilization lift'.

Geosynthetic stabilization of a weak subgrade is provided to allow access of normal construction equipment for the remaining structural lifts. The stabilization lift thickness using a geosynthetic is determined as that for an unpaved road which will only be subjected to a limited number of construction equipment passes. The function of separation (of subgrade and aggregate) in permanent paved road construction is considered the same as mentioned for unpaved road construction. Separation is the primary long-term function of the geosynthetic in permanent pavement applications and is considered key to performance of the pavement system (Koerner and Koerner, supra).

Summary of Research and Design for Subgrade Stabilization Applications

Subgrade stabilization is applicable to the condition of weak subgrades. A geosynthetic is placed directly on the weak subgrade and is used to separate the soft subgrade from the stone base course and to improve the ultimate load carrying capacity of the subgrade. Separation and reinforcement through tensioned-membrane support are important primary geosynthetic functions. Filtration is a secondary consideration when wet soils are involved.

For subgrade stabilization applications of unpaved roads, design procedures of woven geotextiles and geogrids yield similar base course thicknesses for the same set of conditions. Woven geotextiles and geogrids offer a stone base course savings of 30% to 50% and an improvement in ultimate bearing capacity of nearly 100% over the unreinforced conditions. Recent research of unpaved roads constructed on weak subgrades indicates that woven geotextiles prevent contamination of the stone base course while geogrids do not. As a result, woven geotextiles perform better than similar sections reinforced with geogrid alone and offer more than a threefold improvement in the load carrying capacity as compared to the unreinforced section.

For flexible pavements constructed on weak subgrades, separation is the primary long-term function of the geosynthetic. Research of flexible pavements constructed on weak subgrades (CBR<4) has shown that woven geotextiles offer better performance than geogrids because of their ability to act as a separator. Woven geotextiles provide an improvement in excess of 2.5 times the allowable service life for pavement sections with subgrade CBR of 4 or less, mainly because the separation function of the geotextile allows the structural integrity of the stone base course to be maintained during loading.

In summary, when weak subgrades exist (CBR<4), separation appears to be the key to long-term performance of a permanent flexible pavement system. Both separation and reinforcement through tensioned-membrane support are the key functions for unpaved roads constructed on subgrades with CBR values less than 3. Research has shown that woven geotextiles offer better separation characteristics than geogrids and offer equal or better reinforcing capabilities. In light of their lower initial cost, similar design results, and excellent proven performance, woven geotextiles are recommended over geogrids for the construction of unpaved and permanent paved roads when weak subgrades (CBR<4) exist.

When firm subgrade conditions exist, the bearing capacity of the subgrade soil itself is typically capable of supporting the traffic loads. Therefore, tensioned-membrane reinforcement of the type just described is greatly diminished because of the absence of subgrade deformation. However, benefit can be obtained by the incorporation of a geosynthetic to improve the load distribution characteristics and mechanical properties of the base course (Giroud, Ah-Line, and Bonaparte, supra). This geosynthetic application is called base course reinforcement.

Improvement Mechanisms and Functions

Because low normal stresses exist on the geosynthetic and little subgrade deformation occurs, improving the performance of the base course layer requires different geosynthetic characteristics from those needed to stabilize weak subgrade soils (Giroud, Ah-Line, and Bonaparte, supra). A geosynthetic within the base course, or below very thin base courses when firm subgrade conditions exist, provides reinforcement and improves the load-carrying capability of the base course. Reinforcement is a result of the geosynthetic interlocking with the base course and providing lateral confinement, FIG. 2, as opposed to tensioned-membrane support. By interlocking with the base course material, the geosynthetic can prevent shear failure and reduce permanent deformations of the base course (Giroud, Ah-Line, and Bonaparte, supra). The geosynthetic tensile modulus and stiffness are also important variables associated with base course reinforcement (Barksdale, Brown, and Chan, supra).

In summary, base course reinforcement is generally applicable to firm subgrades; a condition which results in a relatively thin base course. A geosynthetic can be placed within a base course, or below very thin base courses for the purpose of increasing the load distribution capability by improving the mechanical properties of the base course. Geosynthetic properties of importance include tensile modulus, stiffness, and the ability to interlock with the base course material.

Design procedures developed for base course reinforcement applications are empirical and unproven. In general, the optimum location for reinforcement is at the bottom of thin base courses and at the midpoint of bases 10 in. thick or greater. The greatest improvement offered by geogrid base course reinforcement is realized when the reinforced section is less than 10 in. The stone base course savings reduces significantly when a greater than 10 in. reinforced base course is required.

SUMMARY OF THE INVENTION

The present invention provides structures, and geosynthetics for such structures, which employ affective subgrade stabilization and base course reinforcement. Membranes according to the present invention may be employed to form such structures, or indeed any desired earthen structure including foundation reinforcement, slope reinforcement, segmental or segmented retaining walls, erosion filled rock bag and other desired structures. These objectives may be obtained according to the present invention in a roadway context, for example, by preparing a subgrade and applying a woven reinforcement membrane according to the present invention before or after at least part of a base course has been applied to the subgrade. Woven reinforcement membrane according to the present invention comprises a plurality of fill member sets, each set formed of a plurality of bracketed fill members extending in a fill direction, and a pair of bracketing fill members disposed adjacent the bracketed fill members extending in the fill direction and bracketing the bracketed fill members. Fill members may be formed of an extruded fill substrate, preferably polypropylene, which is preferably fibrillated or contains a number of slits. The fibrillated fill members are easily woven into the fabric, display excellent filtration and soil retention properties, and feature excellent tensile strength properties. A plurality of warp member sets extend in a warp direction so that alternate warp members in each warp member set are positioned on alternate sides of each fill member intersected by the warp member set. Preferably, a plurality of pairs of locking yarn pairs bracket the warp member sets as they intersect the fill member sets, in order to assist in retaining the warp member sets in place. In the preferred embodiment, the fill member sets, the warp member sets and the locking yarn pairs are formed with extruded polypropylene, because that material provides requisite strength and durability properties at low cost, for these less aggressive subgrade stabilization and base course reinforcement applications. In the preferred embodiment, the fill members and the warp members intersect to form voids in the reinforcement material of a plurality of sizes, preferably at least three. A binder coating is preferably placed on the woven structure, in order to hold the yarns in place. In the preferred embodiment, the binder is formed at least partially of natural rubber, since it is one of the materials which adheres to polypropylene acceptably. Other suitable such materials include acrylics, polyvinyl chloride, polyethylene, polyurethane, polypropylene, vinyl and other chemical treatments.

It is accordingly an object of the present invention to provide an acceptably strong and durable, but acceptably inexpensive, geosynthetic structure which exhibits substantially biaxial strength properties, for use in subgrade stabilization and base course reinforcement applications in roadways, runway and other less aggressive earth reinforcement applications and/or earthen structures.

It is an additional object of the present invention to provide a reinforcement membrane which is a more flexible woven material rather than the generally stiffer extruded plastic grid, so that the reinforcement membrane may be easily rolled after manufacture, transported, unrolled and installed, and so that workers may easily attach or connect adjacent sections of the membrane together.

It is an additional object of the present invention to provide geosynthetic reinforcement membranes in the form of textiles which may be woven on conventional equipment at relative low cost but which contain a large number of strength members extending in both the latitudinal and longitudinal direction so that failure of some members does not mean failure of the membrane.

It is a further object of the present invention to provide earth reinforcement structures in the form of synthetic woven textiles which display superior filtration and base course separation properties because, among other things, they feature voids of a number of sizes.

Other objects, features and advantages of the present invention will become apparent with respect to the remainder of this document.

DETAILED DESCRIPTION OF THE DRAWINGS

Figure 1:
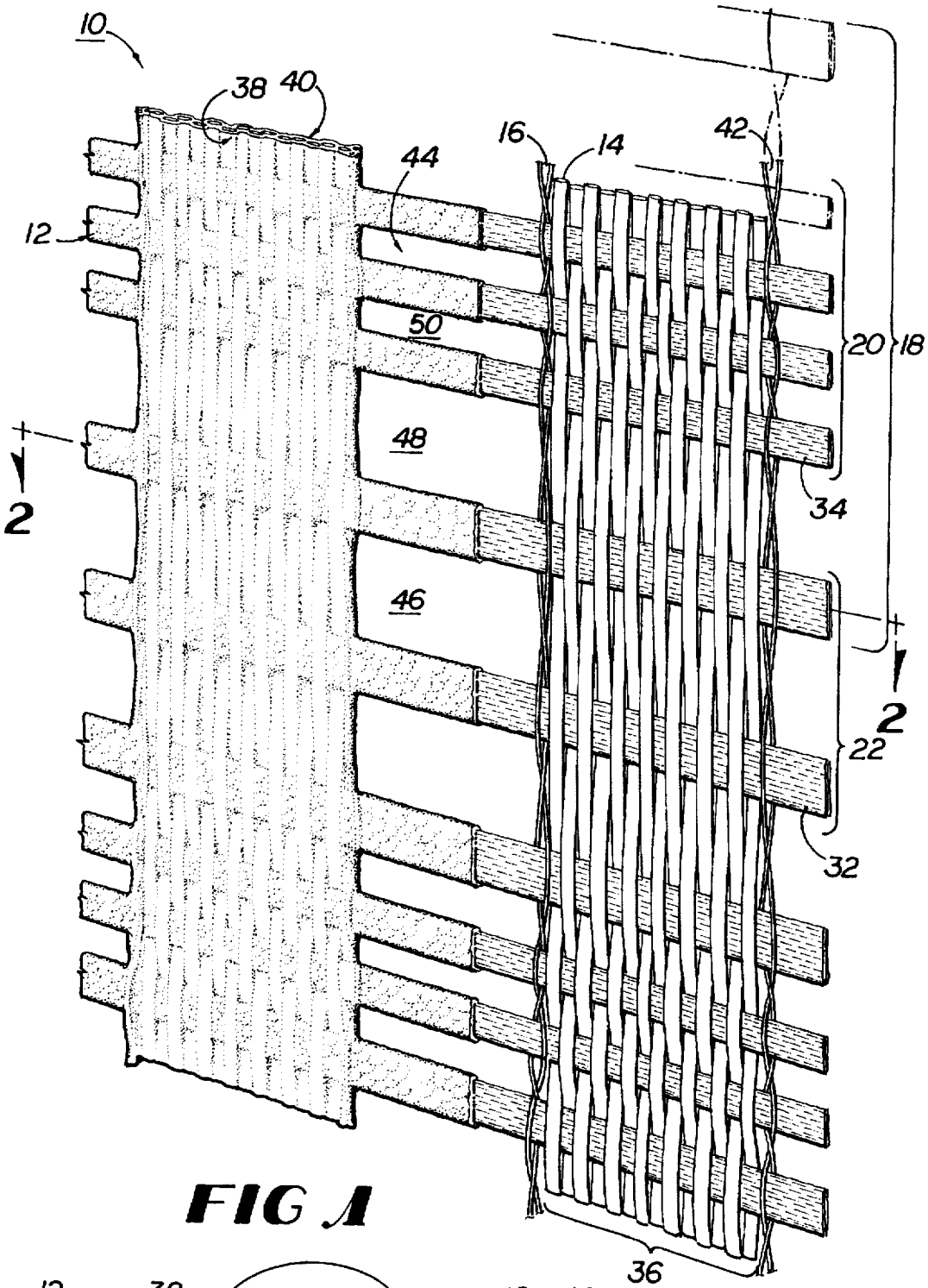
FIG. 1 shows a perspective view of a preferred embodiment of geosynthetic membrane according to the present invention.

FIG. 1 shows a preferred embodiment of membrane 10 according to the present invention. The membrane comprises a number of fill members 12 and a number of warp members 14. The membrane 10 may also contain a plurality of pairs of locking yarns 16. In the preferred embodiment, fill members 12, warp members 14 and locking yarns 16 are formed of polymeric material that has been extruded. Most preferably, the fill members 12, warp members 14 and locking yarns 16 are formed of extruded polypropylene material. Polypropylene provides sufficient tensile strength and durability properties for use in earth reinforcement applications according to the present invention, but is substantially less expensive than other geosynthetic materials such as polyester. In desired applications, however, any polymeric material may be used, including polyethylene, polyester, fiberglass, olefins, various starch products which are biodegradable, combinations of these as desired, and/or other desired polymeric materials.

The fill members 12, warp members 14 and locking yarns 16 may be arranged as desired for any given application. In some applications, for instance, such as on a grade, it may be desirable to include more or larger warp members 14 if the warp direction corresponds to the grade (if the grade is in the fill direction, more fill members could be used.) Additionally, fill members 12 and warp members 14 may be arranged as desired within the membrane such as in desired bundles or sets as shown in FIG. 1, or in any other manner which may be desired for a particular application.

Figure 5:
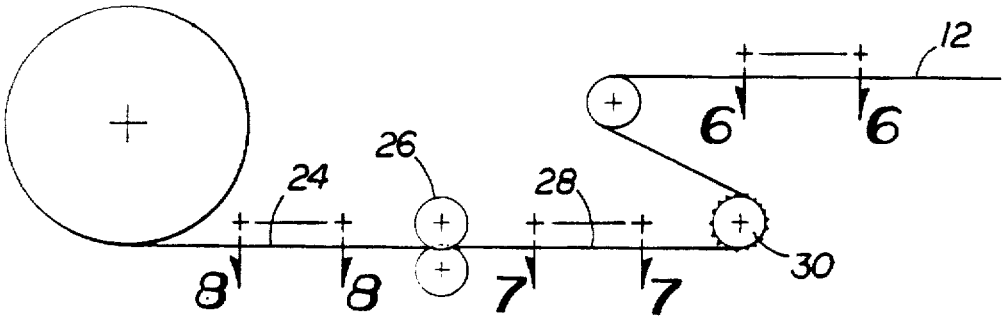
FIG. 5 schematically shows a line process for manufacturing fibrillated fill members according to the present invention.
Figures 6, 7, 8:
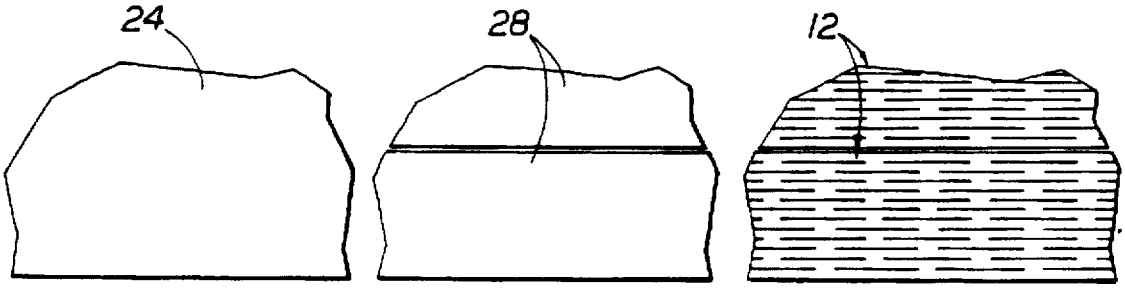
FIG. 6 shows a formed fill member according to the line process of FIG. 5.
FIG. 7 shows a partially formed fill member according to the line process of FIG. 5.
FIG. 8 shows an extruded fill member used in the process of FIG. 5, taken along section 8—8 of FIG. 5.

In the embodiment shown in FIG. 1, which is a preferred form of membrane 10 formed of polypropylene fill members 12, warp members 14 and locking yams 16, for use in conventional roadway or runway earth reinforcement applications, the fill members 12 and warp members 14 are arranged in bundles or sets. As shown in FIG. 1, fill members 12 are arranged in sets 18 comprising six fill members 12. A bracketed subset 20 of fill members 12 is bracketed by a pair of bracketing fill members 22. The bracketing fill members 22 and the bracketed fill members 20 may be of the same structure or they may be different structures. In the preferred embodiment, they are the same and are formed of slit or fibrillated polypropylene film. FIGS. 5–8 show, in schematic form, a line process for forming fill members 12 such as those in bracketed subset 20 and bracketing pair 22, as well as members so formed. As shown in FIG. 5, a roll of extruded polypropylene film 24 feeds a slitter roll 26 which slits the film into a plurality of strips or members 28 as shown in FIG. 7. Each strip or member then passes over a fibrillator roll 30 which contains a plurality of knives or razor edges that place slits in strips 28. The fill members 12 so formed are shown in FIG. 6.

The fill members 12 so formed display excellent tensile strength properties but work well as fill yarns in the weaving process, and provide excellent aeration, filtration and soil retention properties. Obviously, other types of members or yarns may be employed as fill members 12, and combinations of such other types of yarns or members may be employed with or without fill members 12 as shown formed by the line process of FIG. 5.

Figure 4:
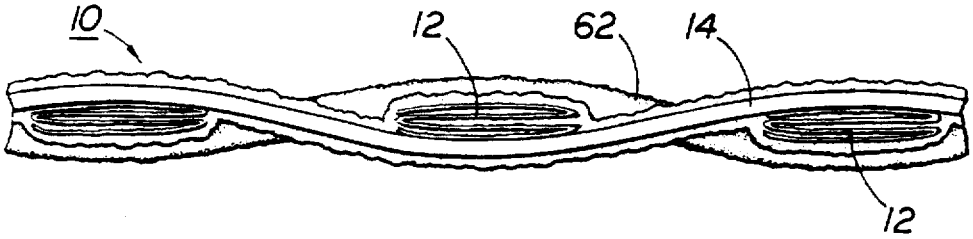
FIG. 4 is an expanded cross-sectional view of a portion of the membrane of FIG. 3 taken along line 4—4 of FIG. 3.

The bracketing pair of fill members 22 acts during the weaving process and afterward to hold bracketed subset of fill members 20 in place. The spacing between a bracketing fill member 32 and a bracketed fill member 34 may be the same as that between bracketed fill members 34, or preferably different. In such cases, the bracketing fill member 32 may migrate away from bracketed fill members 34 by virtue of lateral pressure placed on them by warp members 14 and/or locking yarns 16 during the weaving process. FIG. 4 shows a cross-sectional view of fill members 12 in which the fill has been folded after slitting, although this need not be the case.

Figure 2:
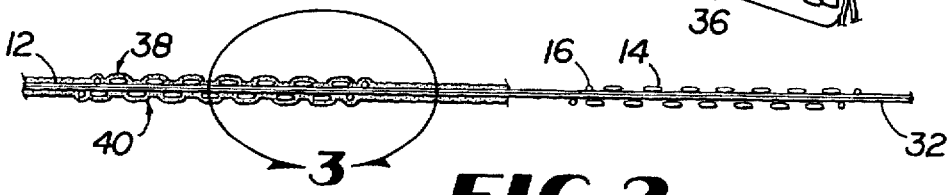
FIG. 2 shows a cross-sectional view of the membrane of FIG. 1 taken along line 2—2 of FIG. 1.
Figure 3:
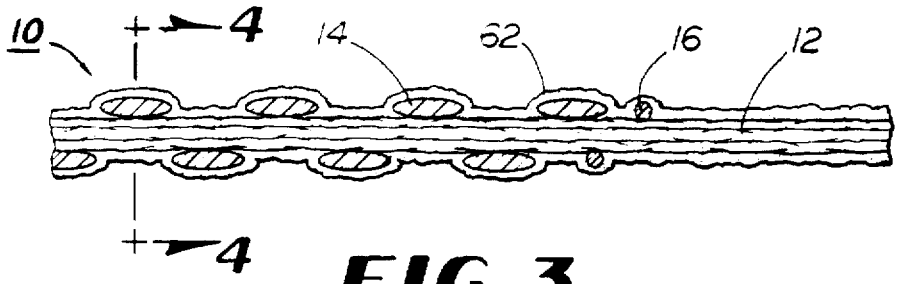
FIG. 3 is an expanded cross-sectional view of the section 3 shown in FIG. 2.

As shown FIGS. 1, 2 and 3, the warp members 14 are preferably woven into a plurality of sets 36 of warp members 14. Each set 36 contains any desired number of warp members 14. In the preferred embodiment shown in FIG. 1, fourteen warp members 14 are employed in a set 36, although any number may be used. The warp members 14 are preferably, again, formed of extruded polypropylene. Alternate warp members 14 are separated during the weaving process as a fill member 12 is thrown, and the separation is then inverted at which time another fill member 12 is thrown. As a result, alternate warp members 14 in each set 36 are positioned on the front and back (top and bottom, first and second) sides 38 and 40, respectively, of membrane 10 or fill members 12 intersected by the warp members 14 and the warp member set 36. Additionally, for the same reasons, a particular warp member 14 is preferably positioned alternately on first and second sides 38 and 40 of successive fill members 12 intercepted by the warp member 14 or its set of warp members 36. FIG. 1 shows such structure.

The weaving process may be carried out on conventional loom equipment employed to weave polypropylene or polymeric textiles. In the preferred embodiment, the loom is a Sulzer loom, and the following members are used:

| | |
|---|---|
| Warp members 14 | Polypropylene, 2975 denier |
| Fill members 12 | Polypropylene, 4600 denier fibrillated |
| Locking members 16 | Polypropylene, 565 denier round yarn |

In the preferred embodiment shown in FIG. 1, pairs of locking yarns 42 bracket warp sets 36. Each locking yarn is preferably formed of extruded polypropylene. Each locking yarn 16 in a pair 42 is alternately positioned on first and second sides 38 and 40 of successive fill members 12 intersected by the locking yarns 16. Alternatively, the particular locking yarn 16 may catch its counterpart in the pair 42 between fill members 12 so that it always passes on either the first side 38 or the second side 40 of fill members 12.

Membrane 10 may, if desired, omit locking yarns 16, which, in any event, are employed primarily to restrain warp member 14 sets 36 in place. The preferred embodiment shown in FIG. 1 which uses such locking yarns 16 in conjunction with bracketing fill members 32, however, creates voids 44 defined by a pair of warp member sets 36 and fill member sets 18. The voids 44 as shown in FIG. 1, in the preferred embodiment, include at least three sizes: a bracketing/bracketing void 46 which is defined by a pair of warp member sets 36 and a pair of bracketing fill members 32; a second bracketing/bracketed void 48 which is smaller than bracketing/bracketing void 46, and a third, bracketed/bracketed void 50 defined by a pair of warp member sets 36 and a pair of bracketed fill members 34. The different sizes of voids 44, 46, 48 and 50 allow membrane 10 to exhibit excellent filtering, soil retention, and gravel retention properties, as compared to other grids or fabrics, which conventionally contain only large, uniformly sized voids.

The membrane 10 is preferably, but need not be, coated with a binder coating after weaving is accomplished. Coating 62 in the preferred embodiment is natural rubber in which the membrane 10 is dipped. The natural rubber adheres well to polypropylene and serves to maintain fill members 12, warp members 14 and locking irons 16 in place. Coating of any desired material may be used, or the coating may be omitted. Other suitable materials for coatings include acrylics, polyvinyl chloride, polyethylene, polyurethane, polypropylene, vinyl and other chemical treatments. The coating may be applied by dipping, by spraying the material, or by any other desired method.

The members and other components of the membrane 10 may also or alternatively be held in place using calendaring, tentering, heat welding, ultrasonic welding, RF welding, or other conventional techniques. These may wholly or partially supplant locking members and/or the coating, or they may be used fully in conjunction with either or both.

The following is a table showing properties of the membrane of FIG. 1, a preferred embodiment of membrane according to the present invention. (The term "MD" means machine or warp direction, and the term "CD" means cross machine or fill direction.)

TABLE 1

| Grid Property | Test Method | Unit | Roll Value MD | Roll Value CD |
|---|---|---|---|---|
| Ultimate Tensile Strength | ASTM D 4595 | lb/ft | 2,434 | 1,270 |
| Tensile Strength @ 2% Strain | ASTM D 4595 | lb/ft | 800 | 360 |
| pH Resistant Range | | | 2–12 | |
| Grid Aperture Size | Measured | in | 0.5 | .5 |

TABLE 2

| | |
|---|---|
| Roll Dimensions | 12.5' × 300' |
| Square Yards Per Roll | 417 |
| Estimated Roll Weight | 150 lbs |

Figure 9:
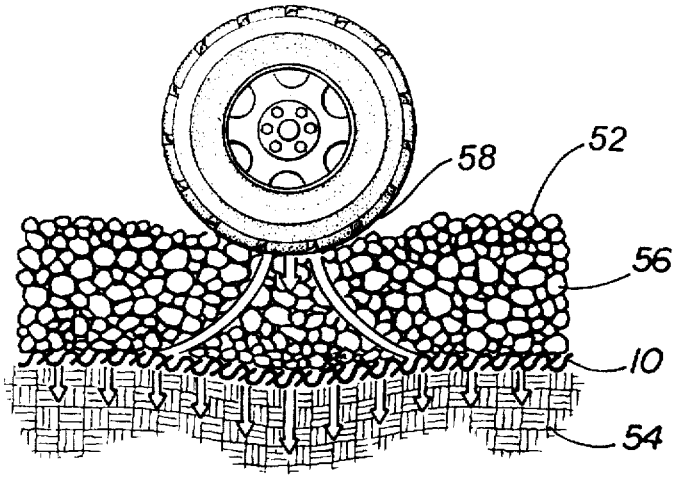
FIG. 9 is a cross sectional view of a roadway according to the present invention which employs membrane according to the present invention absorbing a wheel load.
Figure 10:
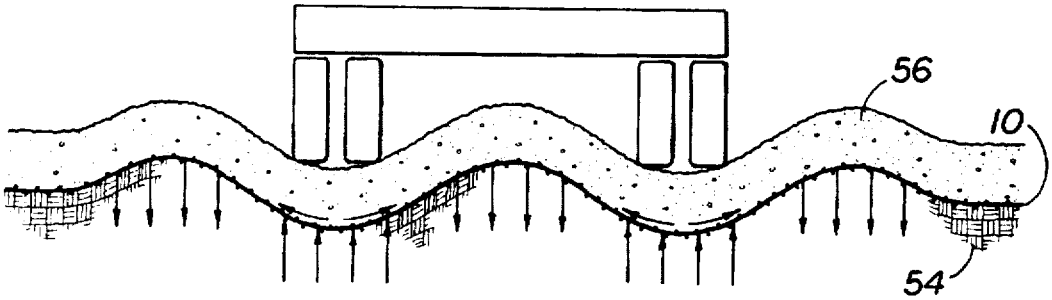
FIG. 10 is a cross-sectional view of a roadway according to the present invention which employs membrane according to the present invention placed between the subgrade and the base course for separation and tensile strength.
Figure 11:
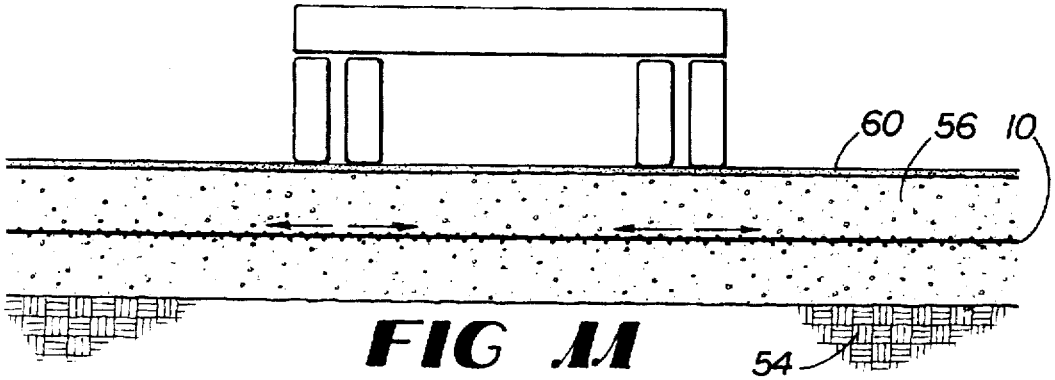
FIG. 11 is a cross sectional view of a roadway according to the present invention with a firm subgrade in which membrane according to the present invention is placed in the base course for base course reinforcement.
Figure 12:
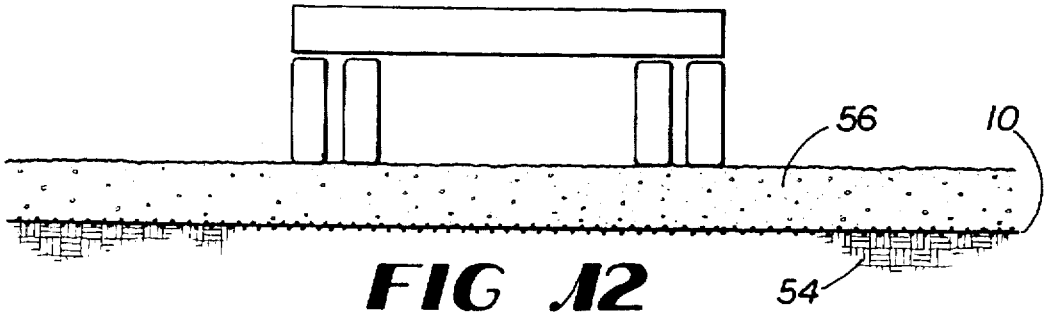
FIG. 12 is a cross sectional view of a membrane according to the present invention with a firm subgrade in which membrane according to the present invention is placed between the subgrade and the base course.

As shown in FIG. 9, membrane 10 according to present invention may be employed in a way structure 52, which may be a roadway, runway, right of way, or any other substantially level, graded surface which is desired to be substantially flat, on a subgrade of 54 with base course 56 and bearing a load 58. (The membrane 10 may, of course, be used on any desired surface, including those with substantial grades, or it may be used in embankments, behind retaining walls, or as otherwise desired where inexpensive earth retaining/reinforcement/stabilization material is needed. For any such applications, the membrane 10 may be made to have biaxial tensile strength properties as desired, or featuring a stronger tensile strength in the warp or fill direction, by adjusting the material from which the yarns are made, the sizes of the yarns, the numbers and spacing of the yarns, and the methods according to which the yarns are made, among other factors. In short, the woven structure of the present invention allows great flexibility in producing a custom prepared material with desired strength and cost properties for any application.)

The way 52 may or may not have a surface 60 such as asphalt or concrete. FIGS. 9–12 show various forms of such ways 52 formed in accordance with the present invention. As shown in FIG. 9, preparation of such a way 52 includes the step of preparing the subgrade 54 (which comprises at least partially soil). For instance, the preparation may include grading, compaction to the maximum density possible and other treatment of subgrade 54. Then, in sites which contain soft subgrade (such as with a CBR less than 3.0), membrane 10 according to the present invention may be placed on a subgrade and overlain with a base course 56 formed of base partially of gravel or aggregate base. Then, a surface 60 may be placed on base course 56 as desired in conventional manner. The biaxial properties of membrane 10 as shown in FIG. 1 absorb tension both laterally and longitudinally in the way 52. Additionally, the woven nature of membrane 10, with its multiple sized voids and great numbers of fill members 12 and warp members 14, serves very efficiently and effectively to separate base course 56 in subgrade 54 in order to prevent undesired migration of gravel into the subgrade 54 and vice-versa.

In sites involving a firmer subgrade (such as those with CBR greater than 3.0) membrane can, according to present invention, be placed between the subgrade 54 and the base course 56, or in the base course 56. In the latter case, the subgrade 54 is prepared and a portion of base course 56 applied thereto. The membrane 10 is then applied to the partial base course 56 and the remainder of base course 56 then applied. A surface 60 may be added to any of these way structures 52.

During installation, adjacent sections of membrane 10 may be stapled, stitched or otherwise easily attached to each other. Selvaging may be formed in conventional fashion as part of membrane 10 to assist in this fastening process.

The foregoing has been provided for purposes of illustration of a preferred embodiment of the present invention. Modifications and changes may be made to the structures and materials shown in this disclosure without departing from the scope or spirit of the invention.

What is claimed is:

1. A way structure, comprising:

A. a subgrade formed at least partially of soil;

B. a base course formed at least partially of a gravel material; and

C. a woven reinforcement membrane contacting the base course, comprising:

1. a plurality of fill member sets, each set formed of a plurality of bracketed fill members extending in a fill direction and a pair of bracketing fill members disposed adjacent the bracketed fill members, extending in the fill direction and bracketing the bracketed fill members, at least some of the fill members comprising a film substrate containing a plurality of slits, the fill member sets featuring first and second sides defining a portion of first and second sides of the reinforcement membrane; and 2. a plurality of warp member sets, each set formed of a plurality of warp yarns extending in a warp direction, alternate warp members in each warp member set positioned on the first and second sides of each fill member intersected by the warp member set, each warp member alternately positioned on first and second sides of successive fill members in a fill member set intersected by the warp member.

2. A way structure according to claim 1 further comprising a plurality of pairs of locking yarn pairs, each pair of pairs bracketing a warp member set, each locking yarn in the pair of pairs alternately positioned on the first and second sides of successive fill members in a fill member set intersected by the locking yarn, the locking yarn crossing the other locking yarn in the pair between successive fill members in the fill member set.

3. A way structure according to claim 1 in which the fill members and the warp members are formed of polymeric material.

4. A way structure according to claim 3 in which the fill members and the warp members are formed of polypropylene.

5. A way structure according to claim 1 in which the fill members and the warp members are formed of polypropylene and the binder coating is formed of natural rubber.

6. A way structure according to claim 1 in which the reinforcement membrane is positioned in the base course.

7. A way structure according to claim 1 in which the reinforcement membrane is positioned between the base course and the subgrade.

8. A way structure, comprising:

A. a subgrade formed at least partially of soil;

B. a base course formed at least partially of a gravel material; and

C. a woven reinforcement membrane contacting the base course, comprising:

1. a plurality of fill member sets, each set formed of a plurality of bracketed fill members extending in a fill direction, and a pair of bracketing fill members disposed adjacent the bracketed fill members, extending in the fill direction and bracketing the bracketed fill members, at least some of the fill members comprising an extruded polypropylene film containing a plurality of slits, the fill member sets featuring first and second sides defining a portion of first and second sides of the reinforcement membrane;

2. a plurality of warp member sets, each set formed of a plurality of warp yarns extending in a warp direction, alternate warp members in each warp member set positioned on the first and second sides of each fill member intersected by the warp member set, each warp member formed of extruded polypropylene and alternately positioned on first and second sides of successive fill members in a fill member set intersected by the warp member;

3. a plurality of pairs of locking yarn pairs, each pair of pairs bracketing a warp member set, a locking yarn in the pair crossing the other locking yarn in the pair between successive fill members in the fill member set, at least some of the locking yarns formed of extruded polypropylene; and 4. a binder coating comprising natural rubber placed on the fill member sets intersected by the warp member sets, the binder coating serving at least partially to retain the fill member sets and the warp member sets in place with respect to each other.

9. A way structure according to claim 8 in which the reinforcement membrane is positioned in the base course.

10. A way structure according to claim 8 in which the reinforcement membrane is positioned between the base course and the subgrade.

11. A way structure according to claim 8 forming a roadway.

12. A way structure according to claim 8 forming a runway.

13. A way structure according to claim 8 in which the membrane features substantially the same tensile strength in the fill and warp directions.

14. A way structure according to claim 8 in which at least some of the locking yarns are alternately positioned on first and second sides of fill members intersected by said yarns.

15. A way structure according to claim 8 in which at least some of the locking yarns are positioned on the same sides of fill members intersected by said yarns.

16. A method of forming a way, comprising the steps of:

A. preparing and grading a subgrade formed at least partially of soil;

B. placing on the subgrade a reinforcement membrane comprising:

1. a plurality of fill member sets, each set formed of a plurality of bracketed fill members extending in a fill direction and a pair of bracketing fill members disposed adjacent the bracketed fill members, extending in the fill direction and bracketing the bracketed fill members, at least some of the fill members comprising a film substrate containing a plurality of slits, the fill member sets featuring first and second sides defining a portion of first and second sides of the reinforcement membrane;

2. a plurality of warp member sets, each set formed of a plurality of warp yarns extending in a warp direction, alternate warp members in each warp member set positioned on the first and second sides of each fill member intersected by the warp member set, each warp member alternately positioned on first and second sides of successive fill members in a fill member set intersected by the warp member; and 3. a binder coating placed on the fill member sets intersected by the warp member sets, the binder coating serving at least partially to retain the fill member sets and the warp member sets in place with respect to each other; and C. placing on the membrane a base course comprising gravel.

17. A method according to claim 16 further comprising the step of placing a surface layer on the base course.

18. A method of forming a way, comprising the steps of:

A. preparing and grading a subgrade formed at least partially of soil;

B. placing on the subgrade a portion of a base course comprising gravel;

C. placing on the portion of the base course a reinforcement membrane comprising:

1. a plurality of fill member sets, each set formed of a plurality of bracketed fill members extending in a fill direction and a pair of bracketing fill members disposed adjacent the bracketed fill members, extending in the fill direction and bracketing the bracketed fill members, at least some of the fill members comprising a film substrate containing a plurality of slits, the fill member sets featuring first and second sides defining a portion of first and second sides of the reinforcement membrane;

2. a plurality of warp member sets, each set formed of a plurality of warp yarns extending in a warp direction, alternate warp members in each warp member set positioned on the first and second sides of each fill member intersected by the warp member set, each warp member alternately positioned on first and second sides of successive fill members in a fill member set intersected by the warp member; and 3. a binder coating placed on the fill member sets intersected by the warp member sets, the binder coating serving at least partially to retain the fill member sets and the warp member sets in place with respect to each other; and D. placing on the membrane the remainder of the base course comprising gravel.

19. A method according to claim 18 further comprising the step of placing a surface layer on the base course.

20. An earthen structure, comprising:

A. a subgrade formed at least partially of soil;

B. a woven reinforcement membrane contacting the subgrade, comprising:

1. a plurality of fill member sets, each set formed of a plurality of bracketed fill members extending in a fill direction and a pair of bracketing fill members disposed adjacent the bracketed fill members, extending in the fill direction and bracketing the bracketed fill members, at least some of the fill members comprising a film substrate containing a plurality of slits, the fill member sets featuring first and second sides defining a portion of first and second sides of the reinforcement membrane;

2. a plurality of warp member sets, each set formed of a plurality of warp yarns extending in a warp direction, alternate warp members in each warp member set positioned on the first and second sides of each fill member intersected by the warp member set, each warp member alternately positioned on first and second sides of successive fill members in a fill member set intersected by the warp member; and 3. a plurality of pairs of locking yarn pairs, each pair of pairs bracketing a warp member set, each locking yarn in the pair of pairs alternately positioned on the first and second sides of successive fill members in a fill member set intersected by the locking yarn, the locking yarn crossing the other locking yarn in the pair between successive fill members in the fill member set; and C. a topgrade comprised at least partially of soil and overlying the membrane.

21. An earthen structure according to claim 20 in which the fill members and the warp members are formed of polymeric material.

22. An earthen structure according to claim 20 further comprising a flexible coating placed on the membrane.

* * * * *